US007225636B2

(12) United States Patent
Baudat

(10) Patent No.: US 7,225,636 B2
(45) Date of Patent: Jun. 5, 2007

(54) APPARATUS AND METHODS FOR PROCESSING HYDROCARBONS TO PRODUCE LIQUIFIED NATURAL GAS

(75) Inventor: Ned P. Baudat, New Branfels, TX (US)

(73) Assignee: Mustang Engineering LP, Houston, TX (US)

( * ) Notice: Subject to any disclaimer, the term of this patent is extended or adjusted under 35 U.S.C. 154(b) by 401 days.

(21) Appl. No.: 10/816,793

(22) Filed: Apr. 1, 2004

(65) Prior Publication Data

US 2005/0217314 A1 Oct. 6, 2005

(51) Int. Cl.
*F25J 1/00* (2006.01)
*F25J 3/00* (2006.01)

(52) U.S. Cl. ..... 62/613; 62/614; 62/620

(58) Field of Classification Search ..... 62/620, 62/630, 611, 612, 613, 614
See application file for complete search history.

(56) References Cited

U.S. PATENT DOCUMENTS 3,360,944 A * 1/1968 Knapp et al. ..... 62/613
3,616,652 A * 11/1971 Engel ..... 62/613
3,729,945 A * 5/1973 Linnett ..... 62/612
5,615,561 A * 4/1997 Houshmand et al. ..... 62/611
5,755,114 A * 5/1998 Foglietta ..... 62/618
6,023,942 A * 2/2000 Thomas et al. ..... 62/613
6,105,391 A * 8/2000 Capron ..... 62/613
6,158,240 A * 12/2000 Low et al. ..... 62/611
6,564,578 B1 * 5/2003 Fischer-Calderon ..... 62/613
2003/0182947 A1 * 10/2003 Kimble et al. ..... 62/48.2

* cited by examiner

*Primary Examiner*—William C. Doerrler
(74) *Attorney, Agent, or Firm*—Gilbreth Roebuck; J. M. (Mark) Gilbreth; Mary A. Gilbreth

(57) ABSTRACT

An apparatus for and process for recovering LNG from reservoir natural gas which includes circulating a portion of the natural gas thru a gas cooling loop that includes heat exchanges, an expansion zone and compression zone. The process also includes removing liquids from the gas cooling loop, distilling those liquids to recover a distilled gas. The process also includes compressing and expanding various portions of the distilled gas and passing those portions thru heat exchangers shared with the gas cooling loop to effect heating/cooling as desired. The process also includes removing a portion of the LNG cooling loop as LNG product.

7 Claims, 1 Drawing Sheet

100
103
105
107
108
109
122
124
125
134
135
137
138
139
141
142
151
152
153
155
156
157
160
131
132
240
220
260
95°F
85°F
51F

APPARATUS AND METHODS FOR PROCESSING HYDROCARBONS TO PRODUCE LIQUIFIED NATURAL GAS

BACKGROUND OF THE INVENTION

1. Field of the Invention

The present invention relates to apparatus and methods for processing hydrocarbons. In another aspect, the present invention relates to apparatus and methods for processing natural gas. In still another aspect, the present invention relates to apparatus and methods for processing natural gas into liquified natural gas.

2. Description of the Related Art

The production of oil is many times accompanied by the production of natural gas. At one time, it would not be unusual to flare this natural gas. More recently, regulatory, economic, and/or public relations considerations have generally dictated that this associated natural gas be disposed of in an acceptable manner, or recovered for sale or other use, such as, for example, as a fuel in the production process, or reinjected back into the formation to assist production.

Of course, where nearby processing infrastructure exists, recovery or proper disposal of this associated gas is generally not an issue. However, in some locations, especially offshore locations, nearby processing infrastructure does not exist, the regulatory and/or economic penalties with associated gas processing, disposal or reinjection may make the oil recovery project economically unfeasible.

The liquefaction of natural gas is generally accomplished by reducing the temperature of natural gas to a liquefaction temperature of about −240° F. to about −260° F. at or near atmospheric pressure. This liquefaction temperature range is typical for many natural gas streams because the boiling point of methane at atmospheric pressure is about −259° F. In order to produce, store and transport LNG, conventional processes known in the art require substantial refrigeration to reduce and maintain natural gas at its liquefaction temperature. The most common of these refrigeration processes are: (1) the cascade process; (2) the single mixed refrigerant process; and (3) the propane pre-cooled mixed refrigerant process.

A cascade process produces LNG by employing several closed-loop cooling circuits, each utilizing a single pure refrigerant and collectively configured in order of progressively lower temperatures. The first cooling circuit commonly utilizes propane or propylene as the refrigerant, the second circuit may utilize ethane or ethylene, while the third circuit generally utilizes methane as the refrigerant.

A single mixed refrigerant process produces LNG by employing a single closed-loop cooling circuit utilizing a multicomponent refrigerant consisting of components such as nitrogen, methane, ethane, propane, butanes and pentanes. The mixed refrigerant undergoes the steps of condensation, expansion and recompression to reduce the temperature of natural gas by employing a unitary collection of heat exchangers known as a "cold box."

A propane pre-cooled mixed refrigerant process produces LNG by employing an initial series of propane-cooled heat exchangers in addition to a single closed-loop cooling circuit, which utilizes a multi-component refrigerant consisting of components such as nitrogen, methane, ethane and propane. Natural gas initially passes through one or more propane-cooled heat exchangers, proceeds to a main exchanger cooled by the multi-component refrigerant, and is thereafter expanded to produce LNG.

Unfortunately for the above processes, the construction and maintenance of such plants is expensive because of the cost of constructing, operating and maintaining one or more external, single or mixed refrigerant, closed-loop cooling circuits.

Another penalty associated with external closed-loop cooling circuits is that such circuits require the use and storage of highly explosive refrigerants that can present safety concerns. Refrigerants such as propane, ethylene and propylene are explosive, while propane and propylene, in particular, are heavier than air further complicating dispersion of these gases in the event of a leak or other equipment failure. This is of particular concern during the offshore production and transport of LNG by ocean going vessels or other floating vessels because of: (1) the large amount of refrigerants that must be stored in order to maintain the liquefaction temperature of natural gas; and (2) the close proximity of these refrigerants to the ships crew.

A number of patents address the processing of natural gas into liquified natural gas.

U.S. Pat. No. 3,360,944 to Knapp et al. produces LNG by separating a natural gas feed stream into a major stream and a minor stream, cooling the major and minor streams to produce a liquid component, and thereafter using a substantial portion a the liquid component as a refrigerant for the process. The liquid component is vaporized while undergoing heat exchange, compressed and discharged from the process. The Knapp process results in only a minor portion of the natural gas feed stream processed into LNG.

U.S. Pat. No. 3,616,652 to Engal discloses a process for producing LNG in a single stage by compressing a natural gas feed stream, cooling the compressed natural gas feed stream to produce a liquefied stream, dramatically expanding the liquefied stream to an intermediate-pressure liquid, and then flashing and separating the intermediate-pressure liquid in a single separation step to produce LNG and a low-pressure flash gas. The low-pressure flash gas is recirculated, substantially compressed and reintroduced into the intermediate pressure liquid. While the Engal process produces LNG without the use of external refrigerants, the process inefficiently utilizes its limited refrigeration capacity upon the entire process stream without conjunctive use of multiple separation steps to offset this severe cooling requirement. Furthermore, the Engal process inefficiently expands its process stream pressure to a level that results in a substantial and highly inefficient recompression of its flash gas. Consequently, the Engal process yields a small volume of LNG compared to the amount of work required for its production, thus reducing the cost viability of the process.

U.S. Pat. No. 5,755,114 issued to Foglietta, discloses a hybrid liquefaction cycle for the production of LNG. The Foglietta process passes a pressurized natural gas feed stream into heat exchange contact with a closed-loop propane or propylene refrigeration cycle prior to directing the natural gas feed stream through a turboexpander cycle to provide auxiliary refrigeration. The Foglietta process can be implemented with only one closed-loop refrigeration cycle, as opposed to cascade type mixed refrigerant systems currently used to produce atmospheric LNG. However, the Foglietta process still requires at least one closed-loop refrigeration cycle comprising propane or propylene, both of which are explosive, not easily dispersed and must be stored on the vessels that transport the Foglietta product.

U.S. Pat. No. 6,023,942 to Thomas et al. discloses a process for producing a methane-rich liquid product having a temperature above about −112° C. (−170° F.) at a pressure that is sufficient for the liquid product to be at or below its bubble point. The resulting product is a pressurized liquid natural gas ("PLNG"), which has a pressure substantially above atmospheric pressure. While the Thomas et al. process can be implemented without external refrigeration, the product is pressurized requiring the use of specially designed heavy, thick-walled containers and transports (e.g., a PLNG ship, truck or railcar). This higher pressure, heavier walled equipment adds substantial weight and expense to any commercial project. The PLNG consumer will also require additional liquefaction, transport, and storage equipment to consume the PLNG, adding further cost to the supply and demand value chain.

U.S. Pat. No. 6,564,578, issued May 20, 2003 to Fischer-Calderon, is directed to a process for producing LNG by directing a feed stream comprising natural gas to a cooling stage that (a) cools the feed stream in at least one cooling step producing a cooled feed stream, (b) expands the cooled feed stream in at least one expansion step by reducing the pressure of the cooled feed stream producing a refrigerated vapor component and a liquid component, and (c) separates at least a portion of the refrigerated vapor component from the liquid component wherein at least a portion of the cooling for the process is derived from at least a portion of the refrigerated vapor component; and repeating steps (a) through (c) one or more times until at least substantial portion of the feed stream in the first cooling stage is processed into LNG wherein the feed stream in step (a) comprises at least a portion of the liquid component produced from a previous cooling stage.

All of the patents cited in this specification, are herein incorporated by reference.

However, in spite of the above advancements, there still exists a need in the art for apparatus and methods for processing natural gas.

This and other needs in the art will become apparent to those of skill in the art upon review of this specification, including its drawings and claims.

SUMMARY OF THE INVENTION

It is an object of the present invention to provide for improved apparatus and methods for processing natural gas.

This and other objects of the present invention will become apparent to those of skill in the art upon review of this specification, including its drawings and claims.

To aid in the understanding of some of the embodiment of this summary, reference will be made to FIG. 1. It should be noted herein, that most of the various process streams are shown in FIG. 1 with leading zero(s), which leading zero(s) may or may not be used herein. For example, process stream 3 is shown in FIG. 1 as "003," and may be referred to herein as process stream "003" or "3." Also, in FIG. 1, some process streams are shown with an alphabetic end character, for example streams 029*a*, 029*b*, 029*b*2, 029*c*, 029*d* and 029*e*. Composition-wise, these streams with the same number but different alphabetic end characters, have the same composition, but may have different temperatures, pressures, and the physical state of the materials flowing therethrough may have changed (i.e., from liquid to gas, or gas to liquid, or from one state to a mixture of states, or a mixture of states to one state).

According to one embodiment of the present invention, there is provided a process for producing liquified natural gas. The process of this embodiment includes all or any combination of the following:

operating a gas cooling loop by (1) contacting a natural gas stream (process stream 003) with a return stream (process stream 009*h*) of the gas cooling loop to form a combined stream (process stream 005), wherein the natural gas stream comprises methane and heavier hydrocarbons, and the return stream (process stream 009*h*) comprises methane, (2) passing the combined stream (process stream 005) through a heat transfer zone and then to a gas cooling loop first gas/liquid separation zone forming a first separation zone gas stream (process stream 008) comprising methane and a gas cooling loop first separation zone liquid stream (process stream 007) comprising heavier hydrocarbons, (3) passing the first separation zone gas stream (process stream 009*a*) through an expansion zone, then through the transfer zone, and then through a compression zone to form the return stream (process stream 009*h*) of the gas cooling loop;

taking the gas cooling loop first separation zone liquid stream (process stream 007) as a distillation zone feed stream (process stream 019), and distilling this distillation zone feed stream (process stream 019) into a distilled gas stream (process stream 021) comprising methane and a bottom stream (process stream 020) comprising heavy hydrocarbons;

operating an LNG cooling loop by (1) passing a return stream (process stream 029*e*) of the LNG cooling loop to a compression zone to form a compressed stream (process stream 051), (2) passing the compressed stream thru the heat transfer zone and then through an expansion zone to form a first expanded stream (process stream 053), (3) combining the first expanded stream with the distilled gas stream (process stream 021*b*) from Step (B) to form a combined LNG stream (process stream 022), (4) splitting the combined LNG stream into a first return LNG stream (process stream 023*a*) and a first remaining LNG stream (process stream 024), (5) expanding and passing the first return LNG stream (process stream 023*a*) through the heat transfer zone and then back to the compression zone (process stream 023*c*), (6) passing the first remaining LNG stream (process stream 024) through the heat transfer zone and then splitting it into a second return LNG stream (process stream 026*a*) and a second remaining LNG stream (process stream 027), (7) expanding and passing the second return LNG stream (process stream 026*a*) through the heat transfer zone, and then back to the compression zone (process stream 026*d*), (8) passing the second remaining LNG stream (process stream 027) through the heat transfer zone and then splitting it into a third return LNG stream (process stream 029*a*) and a third remaining LNG stream (process stream 030), (9) then expanding and passing the third return LNG stream (process stream 29*a*) through the the transfer zone to form the return stream (process stream 029*e*) of the LNG cooling loop, and (10) passing the third remaining LNG stream (process stream 030) to LNG storage and recovering any LNG vapors as an LNG boiloff stream (process stream 039) and combining the boiloff stream with the return stream (process stream 029*e*) of the LNG cooling loop, and recovering LNG product from LNG storage as an LNG product stream (process stream 034).

A more specific embodiment of the above embodiment includes the use of a multizone heat transfer zone. Specifically, according to a more specific embodiment of the above embodiment, there is provided a process for producing liquified natural gas. The process of this embodiment includes all or any combination of the following:

operating a gas cooling loop by (1) contacting a natural gas stream (003) with a return stream (009*h*) of the gas cooling loop to form a combined stream (005), wherein the natural gas stream comprises methane and heavier hydrocarbons, and the return stream (009*h*) comprises methane, (2) passing the combined stream (005) through a first zone of a heat transfer zone and then to a gas cooling loop first gas/liquid separation zone forming a first separation zone gas stream (008) comprising methane and a gas cooling loop first separation zone liquid stream (007) comprising heavier hydrocarbons, (3) passing the first separation zone gas stream (009*a*) through an expansion zone, then through a second zone of the transfer zone, then through the first zone of the heat transfer zone, and then through a compression zone to form the return stream (009*h*) of the gas cooling loop;

taking the gas cooling loop first separation zone liquid stream (007) as a distillation zone feed stream (019), and distilling this distillation zone feed stream (019) into a distilled gas stream (021) comprising methane and a bottom stream (020) comprising heavy hydrocarbons;

operating an LNG cooling loop by (1) passing a return stream (029*e*) of the LNG cooling loop to a compression zone to form a compressed stream (051), (2) passing the compressed stream thru the first zone of the heat transfer zone and then through an expansion zone to form a first expanded stream (053), (3) combining the first expanded stream with the distilled gas stream (021*b*) from Step (B) to form a combined LNG stream (022), (4) splitting the combined LNG stream into a first return LNG stream (023*a*) and a first remaining LNG stream (024), (5) expanding and passing the first return LNG stream (023*a*) thru the first zone of the heat transfer zone and then back to the compression zone (023*c*), (6) passing the first remaining LNG stream (024) through the second zone of the heat transfer zone and then splitting it into a second return LNG stream (026*a*) and a second remaining LNG stream (027), (7) expanding and passing the second return LNG stream (026*a*) through the second zone of the heat transfer zone, through the first zone of the heat transfer zone, and then back to the compression zone (026*d*), (8) passing the second remaining LNG stream (027) through a third zone of the heat transfer zone and then splitting it into a third return LNG stream (029*a*) and a third remaining LNG stream (030), (9) then expanding and passing the third return LNG stream (29*a*) through the third zone, the second zone and then the first zone of the transfer zone to form the return stream (029*e*) of the LNG cooling loop, and (10) passing the third remaining LNG stream (030) to LNG storage and recovering any LNG vapors as an LNG boiloff stream (039) and combining the boiloff stream with the return stream (029*e*) of the LNG cooling loop, and recovering LNG product from LNG storage as an LNG product stream.

According to even another embodiment of the present invention, there is provided an apparatus for producing liquified natural gas. The apparatus includes the equipment as necessary to implement the method embodiments described above, including any portion of the method embodiments as described above.

According to still another embodiment of the present invention, there is provided an apparatus for processing natural gas, the apparatus comprising:

a gas cooling loop unit comprising, a natural gas inlet line for receiving the natural gas, a heat exchange zone, a gas/liquid separation zone having a gas exit line and a liquid exit line, an gas cooling loop expansion zone, and a gas cooling loop compression zone, and gas cooling loop piping defining a gas cooling loop flow path suitable to allow the received natural gas from the inlet line to be combined with a gas cooling loop recycled gas from the compression zone and flow, through a first path through the heat exchange zone, to the gas/liquid separator wherein any condensed liquid exits through the liquid exit line, and any remaining gas exits through the gas exit line, with the remaining gas then passing through the expansion zone, through a second path through the heat exchange zone, through the compression zone to be recycled back as the gas cooling loop recycled gas;

a distillation unit having an inlet, a gas outlet, and a liquid outlet, wherein the inlet is connected to the gas cooling loop liquid exit line;

an LNG cooling loop unit, an LNG compression zone, the heat exchanger zone, an LNG expander, an LNG recovery unit, and LNG piping defining an LNG cooling loop path suitable to allow a compressed LNG boiloff gas and a third LNG recycle gas to be combined into a combined gas which flows through the LNG compression zone, through a third path through the heat exchange zone, through the expander, and through a first LNG splitter and split into a first LNG recycle gas and a first LNG remaining gas, with the first remaining gas flowing through a fourth path through the heat exchange zone, and through a second LNG splitter and split into a second LNG recycle gas and a second LNG remaining gas, with the second remaining gas flowing through a fifth path through the heat exchange zone, and through a third LNG splitter and split into a third LNG recycle gas and a third LNG remaining gas, with the third LNG remaining gas passing through the distillation unit, and distilled into the compressed LNG boiloff gas and an LNG product, with the first LNG recycle gas passing through a sixth path through the heat exchange zone and recycled through the compression zone, with the second LNG recycle gas passing through a seventh path through the heat exchange zone and recycled through the compression zone, and with the third LNG recycle gas passing through a eighth path through the heat exchange zone and recycled to be combined with the LNG boiloff gas, wherein the distillation gas outlet is connected to the LNG cooling loop. In a further embodiment of this embodiment, the distillation gas outlet is connected to the LNG cooling loop immediately prior to the fourth path through the heat exchanger zone.

According to yet another embodiment of the present invention, there is provided an apparatus for processing natural gas, the apparatus comprising:

a gas cooling loop unit comprising, a natural gas inlet line for receiving the natural gas, a heat exchange unit having first, second, and third zones, a gas/liquid separation zone having a gas exit line and a liquid exit line, an gas cooling loop expansion zone, and a gas cooling loop compression zone, and gas cooling loop piping defining a gas cooling loop flow path suitable to allow the received natural gas from the inlet line to be combined with a gas cooling loop recycled gas from the compression zone and flow, through a first path through the first zone of the heat exchange unit, to the gas/liquid separator wherein any condensed liquid exits through the liquid exit line, and any remaining gas exits through the gas exit line, with the remaining gas then passing through the expansion zone, through a second path through the second zone and then first zone of the heat exchange unit, through the compression zone to be recycled back as the gas cooling loop recycled gas;

a distillation unit having an inlet, a gas outlet, and a liquid outlet, wherein the inlet is connected to the gas cooling loop liquid exit line;

an LNG cooling loop unit comprising, an LNG compression zone, the heat exchanger unit, an LNG expander, an LNG recovery unit, and LNG piping defining an LNG cooling loop path suitable to allow a compressed LNG boiloff gas and a third LNG recycle gas to be combined into a combined gas which flows through the LNG compression zone, through a third path through the first zone of the heat exchange unit, through the expander, and through a first LNG splitter and split into a first LNG recycle gas and a first LNG remaining gas, with the first remaining gas flowing through a fourth path through the second zone of the heat exchange unit, and through a second LNG splitter and split into a second LNG recycle gas and a second LNG remaining gas, with the second remaining gas flowing through a fifth path through the third zone of the heat exchange unit, and through a third LNG splitter and split into a third LNG recycle gas and a third LNG remaining gas, with the third LNG remaining gas passing through the distillation unit, and distilled into the compressed LNG boiloff gas and an LNG product, with the first LNG recycle gas passing through a sixth path through the first zone of the heat exchange unit and recycled through the compression zone, with the second LNG recycle gas passing through a seventh path through second zone and then first zone of the heat exchange unit and recycled through the compression zone, and with the third LNG recycle gas passing through a eighth path through the third zone, then second zone, and then first zone of the heat exchange unit and recycled to be combined with the LNG boiloff gas, wherein the distillation gas outlet is connected to the LNG cooling loop unit.

These and other embodiments of the present invention will become apparent to those of skill in the art upon review of this specification, including its drawings and claims.

BRIEF DESCRIPTION OF THE DRAWINGS

In the drawings, it should be understood that like reference numbers refer to like members.

DETAILED DESCRIPTION OF THE INVENTION

Figure 1:
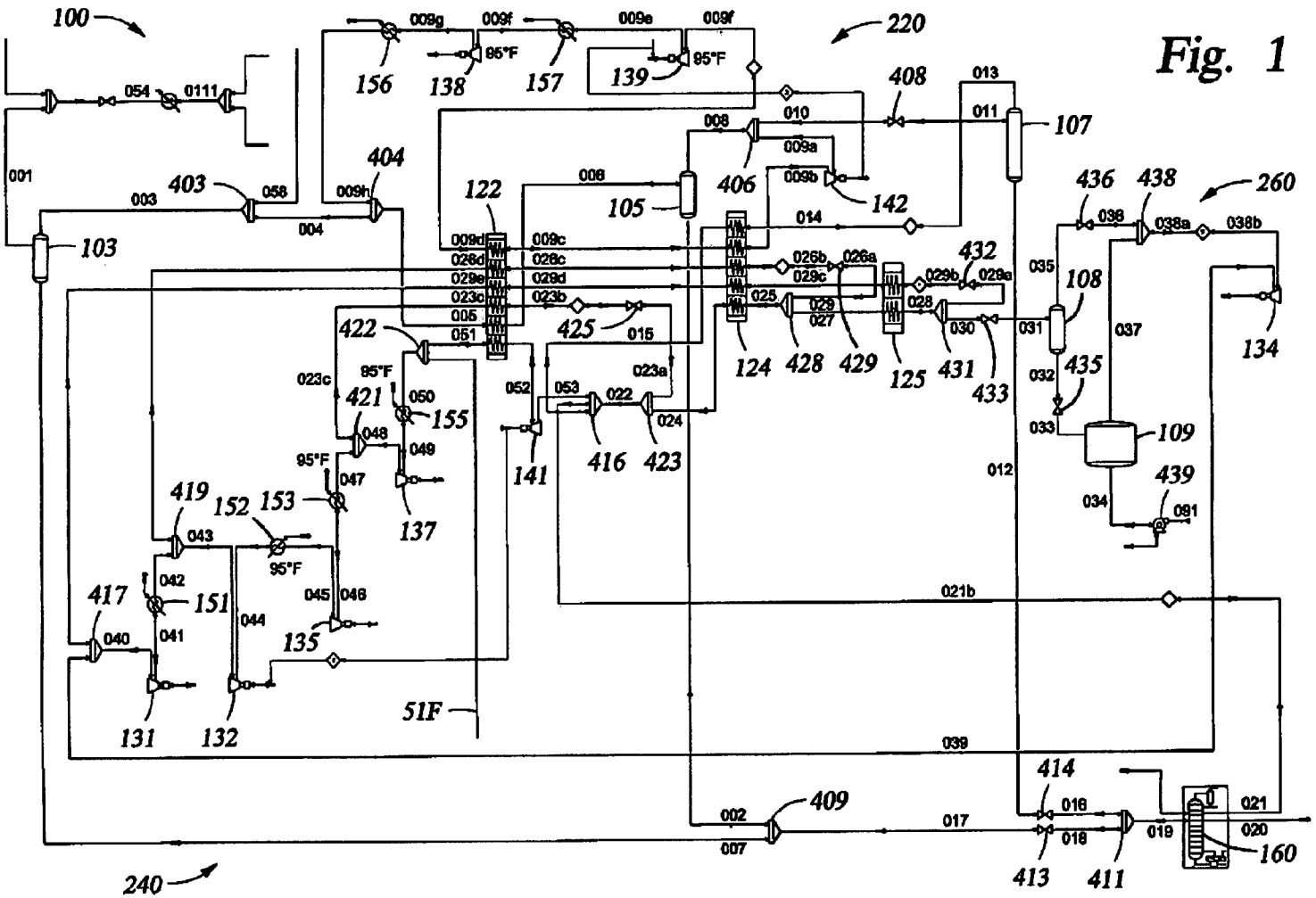
FIG. 1 is a schematic process flow diagram illustrating one embodiment of the process and apparatus of the present invention, showing various process streams and equipment, the main process loops including gas cooling loop 220, LNG cooling loop 240, and liquifaction loop 260, and the main process equipment including separators 103, 105, 107 and 108, compressors 131, 132, 135, 137, 138, 139, and 134, liquifaction exchangers 122, 124, 125, distillation unit 160, and LNG storage tank 109.

The present invention will find utility with a wide variety of natural gas sources, and in a wide variety of environments/locations. While the present invention is believed to have application both onshore and offshore, it may be most useful in the processing of associated gas from geographically remote or offshore oil production facilities, in those instances when gas pipelines are not present at/near the oil production, or are cost prohibitive.

The present invention will now be described by reference to FIG. 1, a schematic illustrating one embodiment of the process and apparatus of the present invention, showing various process streams and equipment. Process 100 includes as main process loops, the gas cooling loop 220, LNG cooling loop 240, and liquifaction loop 260. The main process equipment includes separators 103, 105, 107 and 108, compressors 131, 132, 135, 137, 138, 139, and 134, liquifaction exchangers 122, 124, 125, distillation unit 160, and LNG storage tank 109.

It should be understood that the proposed design operating conditions (i.e., temperature, pressure, flowrates) for the various process streams shown in FIG. 1, can vary depending upon the composition of the input feed gas being processed, equipment design variations, process design variations, and the particular manner in which the equipment and process are being operated. In addition, conditions may also vary depending upon particular operating goals/limitations, which force/require that any plant be operated in a certain manner. Flowrates, of course, vary depending upon plant capacity and size. It should also be noted, that any temperatures, pressures, flowrates, heating/cooling duties, and the like, shown in FIGS. 1 and 2, should be considered merely design examples, and that may vary depending upon any number of design/operational circumstances. It is to be understood that values inside or outside those ranges could be utilized, given particular circumstances.

By way of non-limiting examples only, shown in Table 1 are temperature and pressure ranges are provided for a number of the process streams in FIG. 1.

Also by way of non-limiting example only, shown in Table 2 are composition ranges for a number of selected streams.

TABLE 1 examples of temperature and pressure ranges for selected process streams.

| Stream | Temperature Range (F.) | Pressure Range (psia) |
|---|---|---|
| 6 | 20 to −20 | 2000 to 850 |
| 001 | 20 to −20 | 2000 to 850 |
| 002 | 20 to −20 | 2000 to 850 |
| 003 | 20 to −20 | 2000 to 850 |
| 005 | 20 to −20 | 2000 to 850 |
| 006 | −30 to −60 | 2000 to 850 |
| 007 | −30 to −60 | 2000 to 850 |
| 008 | −30 to −60 | 2000 to 850 |
| 009b | −125 to −175 | 175 to 225 |
| 050 | 85 to 125 | 675 to 750 |
| 052 | 10 to 50 | 675 to 750 |
| 053 | −75 to −35 | 200 to 300 |
| 028 | −250 to −220 | 200 to 300 |
| 034 | −265 to −250 | 15 to 30 |
| 019 | −125 to −75 | 250 to 350 |
| 020 | 275 to 375 | 250 to 350 |
| 021 | 30 to 60 | 250 to 350 |

TABLE 2 examples of composition ranges for selected process streams (mole percent).

| Stream No. | C1 | C2 | C3 | C4 | C5+ |
|---|---|---|---|---|---|
| 6 | 80–90 | 0–10 | 0–10 | 0–5 | 0–5 |
| 001 | 80–90 | 0–10 | 0–10 | 0–5 | 0–5 |
| 002 | 30–60 | 10–30 | 10–30 | 10–30 | 10–30 |
| 003 | 85–95 | 0–10 | 0–10 | 0–5 | 0–5 |
| 005 | 85–95 | 0–10 | 0–10 | 0–5 | 0–5 |
| 006 | 85–95 | 0–10 | 0–10 | 0–5 | 0–5 |
| 007 | 50–70 | 5–20 | 5–20 | 0–5 | 0–5 |
| 008 | 85–95 | 0–10 | 0–10 | 0–5 | 0–5 |
| 009b | 85–95 | 0–10 | 0–10 | 0–5 | 0–5 |
| 050 | 85–95 | 0–10 | 0–10 | 0–5 | 0–5 |
| 052 | 85–95 | 0–10 | 0–10 | 0–5 | 0–5 |
| 053 | 85–95 | 0–10 | 0–10 | 0–5 | 0–5 |
| 028 | 85–95 | 0–10 | 0–10 | 0–5 | 0–5 |
| 034 | 85–95 | 0–10 | 0–5 | 0–1 | 0–1 |
| 019 | 30–70 | 10–30 | 10–30 | 5–10 | 5–10 |
| 020 | 0–1 | 0–1 | 0–5 | 1–10 | 75–95 |

TABLE 2-continued

| Stream No. | examples of composition ranges for selected process streams (mole percent). C1 | C2 | C3 | C4 | C5+ |
|---|---|---|---|---|---|
| 021 | 30–70 | 10–30 | 10–30 | 1–5 | 0–1 |

It should be understood that the various physical components of the present invention may be any that are well known to those of skill in the art. The patentability of the apparatus of the present invention does not reside in the patentablity of any single piece of equipment, but rather in the unique and nonobvious arrangement of the various equipment to form the overall apparatus or portion of the apparatus. Likewise, individual process steps are generally known to those of skill in the art. The patentability of the process of the present invention does not reside in the patentablity of any single process step, but rather in the unique and nonobvious arrangement of the various process steps to form the overall process or a portion of the process.

Inlet gas stream 1 comprises natural gas. As used throughout the specification, natural gas is understood to mean raw natural gas or treated natural gas. Raw natural gas primarily comprises light hydrocarbons such as methane, ethane, propane, butanes, pentanes, hexanes and impurities like benzene, but may also comprise small amounts of non-hydrocarbon impurities, such as nitrogen, hydrogen sulfide, carbon dioxide, and traces of helium, carbonyl sulfide, various mercaptans or water. Treated natural gas primarily comprises methane and ethane, but may also comprise a small percentage of heavier hydrocarbons, such as propane, butanes and pentanes.

While natural gas ideally contains primarily light hydrocarbons, it unfortunately many times also comprises small amounts of non-hydrocarbon impurities, such as nitrogen, hydrogen sulfide, carbon dioxide, and traces of helium, carbonyl sulfide, various mercaptans or water. The exact percentage composition of the raw natural gas is dependant upon its reservoir source and any gas plant pre-processing steps. For instance, natural gas may comprise as little as 55 mole percent methane. However, it is preferable that the natural gas suitable for this process comprises at least about 75 mole percent methane, more preferably at least about 85 mole percent methane, and most preferably at least about 90 mole percent methane for best results. Likewise, the exact composition of the non-hydrocarbon impurities also varies depending upon the reservoir source of the natural gas.

Consequently, it is often necessary to pretreat the natural gas to remove high concentrations of non-hydrocarbon impurities, such as acid gases, mercury and water, that can damage, freeze and plug lines and heat exchangers or other equipment used in the process.

A common optional pretreatment for inlet gas stream 1 includes passing it thru an amine absorber to remove $CO_2$. In addition to its corrosivity, $CO_2$ will also solidify at cryogenic temperatures and cause operational problems in the cryogenic liquification exchanger. Generally, gas to be pretreated thru an amine absorber is first heated to about 100° F., as the heating prevents/reduces foaming in the amine absorption process and increases mass transfer of the $CO_2$ to the amine fluid.

Another common pretreatment for inlet gas stream 1 includes passing it thru a mercury guard bed, as mercury is corrosive to the aluminum equipment commonly used in cryogenic operations. Even if mercury is not seen in the process, it is generally preferred to guard against its presence.

Of course, impurities will vary from gas source to gas source, and any other pretreatments as dictated by the impurities of the particular gas source may be utilized.

Inlet gas stream 1 is received by inlet separator 103 where it is separated into gas stream 3 and liquid stream 2 (the computer model shown in FIG. 1, assumes that stream 6 is split into equal streams 1 and 2, with stream 2 flowing to a second identical process 100.

Gas cooling loop 220 is fed by gas stream 3 which is shown flowing to optional tee 403 where it may be split into rarely used optional emergency fuel gas stream 58 and gas stream 4. Process gas stream 4 flows to tee 404 where it is combined with recycle gas stream **9*h* to form gas stream 5. As will be shown below, this recycle gas stream 9*h* completes cooling loop 220**.

Gas stream 5 is now passed thru a lower, generally first stage of LNG liquefaction exchanger 122 ($1^{st}$ flow path thru the liquefaction exchanger) where it is cooled to about −50° F. and partially condenses.

LNG liquefaction exchanger used herein may be any suitable exchanger known to those of skill in the art, but are preferably multi-sided brazed-aluminum plate-fin heat exchanger. Many streams can enter and exit the exchanger and provide heating or cooling duty to one or more streams simultaneously. One stream may even enter and exit the exchanger several times to achieve staged cooling. The exchanger may be a single exchanger, or may be a combination of several exchanger units, depending on manufacturing availability and/or process design needs. In the non-limiting example shown herein, the liquefaction exchanger comprises exchangers 122, 124 and 125, which may also be thought of as stand alone exchangers, or may be thought of as first, second and third zones of the liquefaction heat exchanger.

Cooled gas stream 5, exiting as gas stream 6, is received by separator 105 where it is separated into gas stream 8 and liquid stream 7. Tee 406 separates gas stream 8 into gas streams **9*a* and 10**.

Gas stream 10 is used to regulate the volume and flow of gas cooling loop 220, and is expanded and cooled into partially condensed stream 11 having a pressure of about 280 psia by expander 408, non-limiting examples of which include a turboexpander or a Joule-Thompson valve. Received into separator 107, stream 11 is separated into gas stream 13 and liquid stream 12. This gas stream 13 becomes gas stream 14 and passes thru LNG liquefaction exchanger ($9^{th}$ flow path) exiting as stream 15 and feeding into mixer 416.

Gas stream **9*a* is expanded by expander 142 to a pressure of about 225 psia into expanded cool gas stream 9*b* to provide cooling duty to the liquefaction exchangers. Gas stream 9*b* is passed thru an upper stage of LNG liquefaction exchanger 124, exiting as gas stream 9*c*, which is then passed thru an upper stage of LNG liquefaction exchanger 122, exiting as gas stream 9*d* ($2^{nd}$ flow path thru exchangers 124 and 122**).

Before gas stream **9*d* can be recycled back to join inlet gas 4 and complete gas cooling loop 220, its pressure must be increased and its temperature cooled to match that of inlet gas stream 4. While one compressor and one heat exchanger could be utilized, the embodiment as shown in FIG. 1, utilizes compressors 138 and 139, and heat exchangers 156 and 157**.

Gas stream 9*d* is compressed by methane booster compressor 139 into discharged gas stream 9*e* having a pressure of about 310 psia. This methane booster compressor 139 is driven by methane expander 142, so the discharge pressure of methane booster compressor depends on the mechanical efficiency of both devices. Stream 9*e* exits heat exchanger 157 as a cooler stream 9*f* at a temperature of about 95° F.

This gas stream 9*f* is compressed by methane compressor 138 into discharged gas stream 9*g* having a pressure of about 310 psia. Stream 9*g* exits heat exchanger 157 as a cooler stream 9*h* at a temperature of about 95° F., and then joins gas stream 4 to complete gas cooling loop 220.

Generally, one or more, preferably all, of the liquid streams removed from gas cooling loop 220 are sent to distillation tower 160. In the embodiment as shown in FIG. 1, liquid streams 2 and 7 are combined at tee 409 into liquid stream 17 which passes thru valve 413 exiting as stream 18. Liquid stream 12 passes thru valve 414 and exits as stream 16. These streams 16 and 18 are combined at tee 411 into stream 19 which is received by distillation tower 160. Heavy hydrocarbon components exit the bottom of distillation tower as stream 20, and may be blended with crude product from the production site, or otherwise sold or disposed. Overhead stream 21 becomes stream 21*b* and flows into LNG cooling loop at mixer 416.

The front end of LNG cooling loop 240 is fed by stream 39 which comprises recovered vapors from LNG receiver 108 and LNG storage tank 109, and recycled cooling stream 29*e*, which are combined at tee 417 into feed stream 40. While the present embodiment is shown illustrated with a series of four compressors 131, 132, 135 and 137 utilized in LNG cooling loop 240, it should be understood that any number of compressors may be utilized as dictated by the process design and economics.

Stream 40 is compressed in first stage LNG compressor 131 and discharged as stream 41 at a pressure of about 85 psia. This stream 41 is cooled by air-cooler 151 into cooled stream 42 having a temperature of about 95° F. Recycled cooling stream 26*d* and stream 41 are combined at mixer 419 into stream 43.

Stream 43 is compressed in LNG booster compressor 132 and discharged as stream 44 at a pressure of about 110 psia. This stream 44 is cooled by air-cooler 152 into cooled stream 45 having a temperature of about 95° F. The LNG booster expander 132 is driven by the LNG refrigerant expander 141, so the discharge pressure of the LNG booster compressor depends on the mechanical efficiency of both devices.

Stream 45 is compressed in third stage LNG compressor 135 and discharged as stream 46 at a pressure of about 205 psia. This stream 46 is cooled by air-cooler 153 into cooled stream 47 having a temperature of about 95° F. Recycled cooling stream 23*c* and stream 47 are combined at mixer 421 into stream 48.

Stream 48 is compressed in fourth stage LNG compressor 137 and discharged as stream 49 at a pressure of about 740 psia. This stream 49 is cooled by air-cooler 155 into cooled stream 50 having a temperature of about 95° F.

Optional tee 422 splits stream 50 into optional stream 51F to allow for fuel gas takeoff if desired, and into stream 51 which is passed thru LNG liquefaction exchanger 122 exiting as stream 52 cooled to about 25° F. ($3^{rd}$ flow path). Gas stream 52 then enters LNG refrigerant expander 141 where it exits as stream 53 at a pressure of about 265 psia and a temperature of about −60° F.

At mixer 416, this stream 53 is combined into stream 22 with earlier described stream 21*b* from overhead of distillation tower 160, and with earlier described stream from overhead of separator 107. It should be understood that these streams 21*b* and 15 may be introduced into LNG cooling loop 240 at any number of suitable points. Preferably, streams 21*b* and 15 are introduced into LNG cooling loop 240 to rather immediately through the $4^{th}$ flow path, although any number of other points might also be suitable depending upon process conditions. Generally, streams 21*b* and 15 are introduced into LNG cooling loop 240 at points that are efficient for the process, which generally means trying to match temperature, pressure, and/or composition of these streams to the introduction point.

Stream 22 is split by tee 423 ($1^{st}$ splitter) into streams 23*a* and 24B. Stream 23*a* is expanded thru valve 425 into stream 23*b*, which passes thru LNG liquefaction exchanger 122 ($6^{th}$ flow path), exiting as earlier described recycled cooling stream 23*c* which feeds into mixer 421.

Stream 24 passes thru LNG liquefaction exchanger 124 ($4^{th}$ flow path), exiting as stream 25, which is split by tee 428 into stream 26*a* and stream 27.

Stream 26*a* is expanded thru valve 429 into stream 26*b*, which passes thru LNG liquefaction exchanger 124, exiting as stream 26*c*. This stream 26*c* then passes thru LNG liquefaction exchanger 122, exiting as earlier described recycled cooling stream 26*d* which feeds into mixer 419 ($7^{th}$ flow path thru exchangers 124 and 122).

Stream 27 passes thru LNG liquefaction unit 125 exiting as stream 28 ($5^{th}$ flow path). This stream 28 is split tee 431 into streams 29*a* and 30.

Stream 29*a* is expanded thru valve 432 into stream 29*b*, which passes thru LNG liquefaction exchanger 125, exiting as stream 29*c*. Next, stream 29*c* passes thru LNG liquefaction exchanger 124, exiting as stream 29*d*. This stream 29*c* then passes thru LNG liquefaction exchanger 125 ($8^{th}$ flow path through exchangers 125, 124 and 122), exiting as earlier described recycled cooling stream 29*e* which feeds into mixer 417 at the front end of LNG cooling loop 240.

It should be understood that the various recycle streams 29*e*, 26*d*, 23*c* can be recycled back into LNG cooling loop 240 at more points than just those shown in FIG. 1. Generally, these recycle streams in recycled back into LNG cooling loop 240 at points that are efficient for the process, which generally means trying to match temperature, pressure, and/or composition of the recycle stream to the recycle point.

Gas stream 30 is expanded thru valve 433 where it liquefies, forming stream 31 at pressure of about 20 psia and a temperature of about −250° F. This LNG stream 31 is received by LNG receiver vessel 108.

LNG receiver vessel liquid stream 32 passes thru valve 435 and enters as stream 33 into LNG storage tank 109. LNG receiver vessel vapor stream 35 passes thru valve 436 forming stream 36, which is joined at mixer 438 by LNG storage tank vapor stream 37, to form stream 38*a* which becomes stream 38*b*. LNG boiloff compressor 134 compresses stream 38*b* to about 25 psia into earlier described stream 39, which feeds into mixer 417 at the front end of LNG cooling loop 240.

Liquid remaining in LNG storage tank 109 is the final LNG product and can be sold or stored as necessary. LNG product stream 34 feeds into the intake side of LNG product pump 439.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A process for producing liquified natural gas comprising:

(A) operating a gas cooling loop by (1) contacting a natural gas stream with a return stream of the gas cooling loop to form a combined stream, wherein the natural gas stream comprises methane and heavier hydrocarbons, and the return stream comprises methane, (2) passing the combined stream through a first zone of a heat transfer zone and then to a gas cooling loop first gas/liquid separation zone forming a first separation zone gas stream comprising methane and a gas cooling loop first separation zone liquid stream comprising heavier hydrocarbons, (3) passing the first separation zone gas stream through an expansion zone, then through a second zone of the heat transfer zone, then through the first zone of the heat transfer zone, and then through a compression zone to form the return stream of the gas cooling loop;

(B) taking the gas cooling loop first separation zone liquid stream as a distillation zone feed stream, and distilling this distillation zone feed stream into a distilled gas stream comprising methane and a bottom stream comprising heavy hydrocarbons;

(C) operating an LNG cooling loop by (1) passing a return stream of the LNG cooling loop to a compression zone to form a compressed stream, (2) passing the compressed stream thru the first zone of the heat transfer zone and then through an expansion zone to form a first expanded stream, (3) combining the first expanded stream with the distilled gas stream from Step (B) to form a combined LNG stream, (4) splitting the combined LNG stream into a first return LNG stream and a first remaining LNG stream, (5) expanding and passing the first return LNG stream thru the first zone of the heat transfer zone and then back to the compression zone, (6) passing the first remaining LNG stream through the second zone of the heat transfer zone and then splitting it into a second return LNG stream and a second remaining LNG stream, (7) expanding and passing the second return LNG stream through the second zone of the heat transfer zone, through the first zone of the heat transfer zone, and then back to the compression zone, (8) passing the second remaining LNG stream through a third zone of the heat transfer zone and then splitting it into a third return LNG stream and a third remaining LNG stream, (9) then expanding and passing the third return LNG stream through the third zone, the second zone and then the first zone of the transfer zone to form the return stream of the LNG cooling loop, and (10) passing the third remaining LNG stream to LNG storage and recovering any LNG vapors as an LNG boiloff stream and combining the boiloff stream with the return stream of the LNG cooling loop, and recovering LNG product from LNG storage as an LNG product stream.

2. The process of claim 1, further comprising:

in step (A), prior to contacting the natural gas stream with a return stream of the gas cooling loop, first removing any liquids from the natural gas stream, which liquids are then combined with the distillation zone feed stream of step (B).

3. The process of claim 1, further comprising:

removing a portion of the first separation zone gas stream of step (A) as a side stream;

expanding the side stream and separating it into a gas side stream and a liquid side stream;

combining the liquid side stream with the distillation zone feed stream of step (B); and passing the gas side stream through the second portion of the heat transfer zone and combining it with the first expanded stream and the distilled gas stream from Step (B) to form the combined LNG stream.

4. A process for producing liquified natural gas comprising:

(A) operating a gas cooling loop by (1) contacting a natural gas stream with a return stream of the gas cooling loop to form a combined stream, wherein the natural gas stream comprises methane and heavier hydrocarbons, and the return stream comprises methane, (2) passing the combined stream through a heat transfer zone and then to a gas cooling loop first gas/liquid separation zone forming a first separation zone gas stream comprising methane and a gas cooling loop first separation zone liquid stream comprising heavier hydrocarbons, (3) passing the first separation zone gas stream through an expansion zone, then through the heat transfer zone, and then through a compression zone to form the return stream of the gas cooling loop;

(B) taking the gas cooling loop first separation zone liquid stream as a distillation zone feed stream, and distilling this distillation zone feed stream into a distilled gas stream comprising methane and a bottom stream comprising heavy hydrocarbons;

(C) operating an LNG cooling loop by (1) passing a return stream of the LNG cooling loop to a compression zone to form a compressed stream, (2) passing the compressed stream thru the heat transfer zone and then through an expansion zone to form a first expanded stream, (3) splitting the first expanded stream into a first return LNG stream and a first remaining LNG stream, (4) expanding and passing the first return LNG stream through the heat transfer zone and then back to the compression zone, (5) passing the first remaining LNG stream through the heat transfer zone and then splitting it into a second return LNG stream and a second remaining LNG stream, (6) expanding and passing the second return LNG stream through the heat transfer zone, and then back to the compression zone, (7) passing the second remaining LNG stream through the heat transfer zone and then splitting it into a third return LNG stream and a third remaining LNG stream, (8) then expanding and passing the third return LNG stream through the transfer zone to form the return stream of the LNG cooling loop, (9) passing the third remaining LNG stream to LNG storage and recovering any LNG vapors as an LNG boiloff stream and combining the boiloff stream with the return stream of the LNG cooling loop, and recovering LNG product from LNG storage as an LNG product stream, and (10) introducing the distilled gas stream from Step (B) into the LNG cooling loop.

5. An apparatus for processing natural gas, the apparatus comprising:

a gas cooling loop unit comprising, a natural gas inlet line for receiving the natural gas, a heat exchange zone, a gas/liquid separation zone having a gas exit line and a liquid exit line, an gas cooling loop expansion zone, and a gas cooling loop compression zone, and gas cooling loop piping defining a gas cooling loop flow path suitable to allow the received natural gas from the inlet line to be combined with a gas cooling loop recycled gas from the compression zone and flow, through a first path through the heat exchange zone, to the gas/liquid, separator wherein any condensed liquid exits through the liquid exit line, and any remaining gas exits through the gas exit line, with the remaining gas then passing through the expansion zone, through a second path through the heat exchange zone, through the compression zone to be recycled back as the gas cooling loop recycled gas;

a distillation unit having an inlet, a gas outlet, and a liquid outlet, wherein the inlet is connected to the gas cooling loop liquid exit line;

an LNG cooling loop unit, an LNG compression zone, the heat exchanger zone, an LNG expander, an LNG recovery unit, and LNG piping defining an LNG cooling loop path suitable to allow a compressed LNG boiloff gas and a third LNG recycle gas to be combined into a combined gas which flows through the LNG compression zone, through a third path through the heat exchange zone, through the expander, and through a first LNG splitter and split into a first LNG recycle gas and a first LNG remaining gas, with the first remaining gas flowing through a fourth path through the heat exchange zone, and through a second LNG splitter and split into a second LNG recycle gas and a second LNG remaining gas, with the second remaining gas flowing through a fifth path through the heat exchange zone, and through a third LNG splitter and split into a third LNG recycle gas and a third LNG remaining gas, with the third LNG remaining gas passing through the distillation unit, and distilled into the compressed LNG boiloff gas and an LNG product, with the first LNG recycle gas passing through a sixth path through the heat exchange zone and recycled through the compression zone, with the second LNG recycle gas passing through a seventh path through the heat exchange zone and recycled through the compression zone, and with the third LNG recycle gas passing through a eighth path through the heat exchange zone and recycled to be combined with the LNG boiloff gas, wherein the distillation gas outlet is connected to the LNG cooling loop.

6. The apparatus of claim 5, wherein the distillation gas outlet is connected to the LNG cooling loop immediately prior to the fourth path through the heat exchanger zone.

7. An apparatus for processing natural gas, the apparatus comprising:

a gas cooling loop unit comprising, a natural gas inlet line for receiving the natural gas, a heat exchange unit having first, second, and third zones, a gas/liquid separation zone having a gas exit line and a liquid exit line, an gas cooling loop expansion zone, and a gas cooling loop compression zone, and gas cooling loop piping defining a gas cooling loop flow path suitable to allow the received natural gas from the inlet line to be combined with a gas cooling loop recycled gas from the compression zone and flow, through a first path through the first zone of the heat exchange unit, to the gas/liquid separator wherein any condensed liquid exits through the liquid exit line, and any remaining gas exits through the gas exit line, with the remaining gas then passing through the expansion zone, through a second path through the second zone and then first zone of the heat exchange unit, through the compression zone to be recycled back as the gas cooling loop recycled gas;

a distillation unit having an inlet, a gas outlet, and a liquid outlet, wherein the inlet is connected to the gas cooling loop liquid exit line;

an LNG cooling loop unit comprising, an LNG compression zone, the heat exchanger unit, an LNG expander, an LNG recovery unit, and LNG piping defining an LNG cooling loop path suitable to allow a compressed LNG boiloff gas and a third LNG recycle gas to be combined into a combined gas which flows through the LNG compression zone, through a third path through the first zone of the heat exchange unit, through the expander, and through a first LNG splitter and split into a first LNG recycle gas and a first LNG remaining gas, with the first remaining gas flowing through a fourth path through the second zone of the heat exchange unit, and through a second LNG splitter and split into a second LNG recycle gas and a second LNG remaining gas, with the second remaining gas flowing through a fifth path through the third zone of the heat exchange unit, and through a third LNG splitter and split into a third LNG recycle gas and a third LNG remaining gas, with the third LNG remaining gas passing through the distillation unit, and distilled into the compressed LNG boiloff gas and an LNG product, with the first LNG recycle gas passing through a sixth path through the first zone of the heat exchange unit and recycled through the compression zone, with the second LNG recycle gas passing through a seventh path through second zone and then first zone of the heat exchange unit and recycled through the compression zone, and with the third LNG recycle gas passing through a eighth path through the third zone, then second zone, and then first zone of the heat exchange unit and recycled to be combined with the LNG boiloff gas, wherein the distillation gas outlet is connected to the LNG cooling loop unit.

* * * * *